US012290849B2

(12) United States Patent
Enderes et al.

(10) Patent No.: US 12,290,849 B2
(45) Date of Patent: May 6, 2025

(54) BENDING HEAD FOR WELDED WIRE MESH

(71) Applicant: Progress Maschinen & Automation AG, Brixen (IT)

(72) Inventors: Karl Friedrich Enderes, Brixen (IT); Alexander Stuflesser, Lajen (IT)

(73) Assignee: PROGRESS MASCHINEN & AUTOMATION AG, Brixen (IT)

( * ) Notice: Subject to any disclaimer, the term of this patent is extended or adjusted under 35 U.S.C. 154(b) by 318 days.

(21) Appl. No.: 17/896,593

(22) Filed: Aug. 26, 2022

(65) Prior Publication Data

US 2022/0410238 A1 Dec. 29, 2022

Related U.S. Application Data

(63) Continuation of application No. PCT/EP2021/054306, filed on Feb. 22, 2021.

(30) Foreign Application Priority Data

Mar. 3, 2020 (AT) ..... A 50158/2020

(51) Int. Cl.
*B21D 11/22* (2006.01)
*B21D 11/12* (2006.01)

(52) U.S. Cl.
CPC ..... *B21D 11/125* (2013.01); *B21D 11/22* (2013.01)

(58) Field of Classification Search
CPC ..... B21D 7/022; B21D 7/024; B21D 11/22; B21D 11/125; B21D 7/02; B21F 27/005
See application file for complete search history.

(56) References Cited

U.S. PATENT DOCUMENTS 3,260,091 A * 7/1966 Shaw, Jr. ..... B21D 11/10 72/157
3,680,347 A * 8/1972 Schenck ..... B21D 7/024 72/217

(Continued)

FOREIGN PATENT DOCUMENTS

AT 512 400 8/2013
CN 104209432 12/2014

(Continued)

OTHER PUBLICATIONS

CN 110216177A, Hang Sep. 2019.*

(Continued)

*Primary Examiner* — Edward T Tolan
(74) *Attorney, Agent, or Firm* — Wenderoth, Lind & Ponack, L.L.P.

(57) ABSTRACT

A bending head for welded wire mesh includes a frame, a bending face to be moved relative to the frame for bending a wire in a welded wire mesh, a counterholder on which the wire can be braced during bending by the bending face, a bending die which, at least in part, has a predefined bending radius, a bending arm on which the bending face is arranged, and an arm drive device with which the bending arm can be adjusted relative to the frame. A support is provided at which the bending arm is movably mounted. A support drive device, with which the support can be adjusted relative to the frame and which is separate from the arm drive device, is provided.

30 Claims, 6 Drawing Sheets

(56) References Cited

U.S. PATENT DOCUMENTS

| | | | | |
|---|---|---|---|---|
| 3,774,434 | A | 11/1973 | Bock | |
| 3,922,901 | A * | 12/1975 | Hillegas | B23D 21/04 72/298 |
| 4,750,346 | A * | 6/1988 | Traub | B21D 7/024 72/149 |
| 5,316,052 | A | 5/1994 | Ritter et al. | |
| 2015/0209856 | A1 | 7/2015 | Tremmel et al. | |

FOREIGN PATENT DOCUMENTS

| | | |
|---|---|---|
| CN | 209156794 | 7/2019 |
| EP | 1 002 592 | 5/2000 |
| JP | 51-35776 | 3/1976 |
| JP | 6-142775 | 5/1994 |
| JP | 2009-142863 | 7/2009 |
| SU | 662199 | 5/1979 |
| WO | 93/01904 | 2/1993 |
| WO | 2014/015349 | 1/2014 |

OTHER PUBLICATIONS

EP 0445081A2, Caporusso Sep. 1991.*
JP 59-156517A, Yogo Sep. 1984.*
CN 110576087A, Wu et al. Dec. 2019.*
International Search Report dated May 18, 2021 in corresponding International Application No. PCT/EP2021/054306.

* cited by examiner

BENDING HEAD FOR WELDED WIRE MESH

BACKGROUND OF THE INVENTION

The invention relates to a bending head for welded wire mesh, comprising a frame, at least one bending face which can be moved relative to the frame for bending at least one wire in a welded wire mesh, at least one counterholder on which the at least one wire can be braced during bending by the at least one bending face, at least one bending die, which, at least in part, has a predefined bending radius, at least one bending arm, on which the at least one bending face is arranged, and at least one arm drive device, with which the at least one bending arm can be adjusted relative to the frame. The invention furthermore relates to a system for producing welded wire mesh comprising at least one such bending head, as well as a method for bending at least one wire in a welded wire mesh by means of at least one such bending head.

A bending head 101 according to the state of the art is represented in FIG. 1. The bending head 101 comprises a frame 103, a bending face 104, which can be moved relative to the frame 103, for bending a wire in a welded wire mesh, a counterholder 106, on which the wire can be braced during bending by means of the bending face 104, a bending die 107, a bending arm 109, on which the bending face 104 is arranged, and an arm drive device 110, with which the bending arm 109 can be adjusted relative to the frame 103.

The counterholder 106 is arranged on a pivot lever 116 and can be pivoted relative to the frame 103.

With the arm drive device 110, the bending arm 109 can be rotated about an axis of rotation 113. A control roller 114, which runs on a control contour 115 during a movement of the bending arm 109, is arranged on an end of the bending arm 109 opposite the bending face 104. Via the control roller 114 and the control contour 115, the movement of the bending face 104 can be modified such that it deviates from a pure circular path and follows a predefined bending trajectory.

The bending trajectory represents a compromise, which has to satisfy the entire wire spectrum to be processed, which is disadvantageous, however, as the bends which can be performed with the bending head are limited thereby. For example, only bends with a defined leg length can be carried out.

A further disadvantage of the bending head is that the end of the bending arm 109 on which the bending face 104 is arranged requires a large movement space during a bending, which requires a relatively large distance between neighboring wires from which the welded wire mesh is welded together.

If the welded wire mesh is arranged above the bending head on a mesh table, the large movement space for the end of the bending arm 109 also requires a relatively large cutout in this mesh table, through which the end of the bending arm 109 protrudes. The large table cutout in turn brings about an insufficient bracing of the welded wire mesh, which leads to a sagging in the region of the bending to be performed, which can impair the precision of the bending. In the worst case, a cutout that is too large can also lead to the welded wire mesh getting caught, which can also bring about a danger for the operating personnel.

Finally, a further disadvantage in the case of bending heads according to the state of the art is that the bending heads require a large installation space, which limits their possible applications in systems for producing welded wire mesh.

SUMMARY OF THE INVENTION

The object of the present invention is to at least partially remedy the disadvantages of the state of the art and to specify a bending head which is improved compared with the state of the art, and which in particular makes it possible to move the bending face along a variable bending trajectory optimally adapted to the parameters of the bending to be performed, and has a small movement space as well as a small installation space. A further object is to specify a system for producing welded wire mesh comprising at least one bending head improved in such a way, as well as a method for bending at least one wire in a welded wire mesh by means of at least one bending head improved in such a way.

In the bending head according to the invention, therefore, at least one support is provided, at and/or on which (i.e., at which) the at least one bending arm is movably mounted. At least one support drive device, which is separate from the at least one arm drive device and with which the at least one support can be adjusted relative to the frame, is provided.

Individual wires in a welded wire mesh can be bent with the bending head. Welded wire mesh serves to reinforce concrete components. The wires can be arranged, for example, on one of the sides of the welded wire mesh, on an opening for a window or a door or inside the mesh. In this case, the wire to be bent as a rule acts as a spacer from a further mesh layer. With the bending head, bends which have a first and a second deflection of 90° in each case and a piece of wire with a freely selectable leg length arranged in between can be carried out for example. Bends which have a single deflection of 180° can also be carried out.

An important principle of the bending head is that the bending trajectory can be designed variable because at least two output drives which are independent of each other are provided, namely the arm drive device on the one hand and the support drive device, which is separate therefrom, on the other hand. It is thereby possible to adjust the at least one support relative to the frame with the aid of the at least one support drive device and, independently thereof, to move the at least one bending arm, which is movably mounted at and/or on the at least one support, relative to the at least one support and relative to the frame with the aid of the at least one arm drive device.

The bending trajectory performed by the at least one bending face can thereby be optimally adapted to the parameters of the bending of the at least one wire to be carried out. One parameter represents, for example, the wire diameter, which can lie e.g. between 6 and 16 mm. A bending die with a predefined bending radius can be used depending on the wire diameter. Another parameter represents the leg length between two successive partial bends. Because of the variable bending trajectory, this leg length can be freely selected. In particular, relatively short leg lengths are also feasible.

Because at least two output drives which are independent of each other are provided, it is also possible to reduce the dimensions of the movement space utilized by the region of the bending arm in which the bending face is arranged during a bending compared with the state of the art. It is thereby possible to reduce the table cutout required for the bending arm if a mesh table is used. At the same time, spacer wires in the under mesh of a solid wall cage with a cross-iron spacing, which is reduced compared with the state of the art, of e.g. 150 mm can be bent by the bending head.

A further advantage of the bending head is that, because the at least one bending arm is arranged at and/or on the at least one support, a compact structural shape of the bending head is feasible. In turn, this broadens the possible applications of the bending head in a system for producing welded wire mesh.

According to a preferred embodiment, the at least one support is mounted on the frame rotatably about an axis of rotation, and preferably the at least one bending arm is arranged at and/or on (i.e., at) the at least one support such that the axis of rotation intersects the at least one bending arm. The bending head can hereby be constructed very compact, whereby the bending head can also be used in unfavorable spatial conditions.

It is appropriate that the support drive device comprises at least one slider crank mechanism, and preferably the at least one slider crank mechanism has at least one crank, at least one lever, and/or at least one connecting rod.

It has proved to be advantageous that the at least one bending arm is mounted at and/or on the at least one support displaceably, preferably linearly. Preferably, at least one bearing is arranged on the at least one support, on which at least one guide for the at least one bending arm is formed, and particularly preferably two bearings are arranged on the at least one support. Through these measures, individually or in combination with each other, the leg length of a bending can be particularly easily adapted as desired.

With respect to a compact construction of the bending head, it has proved to be favorable that the at least one arm drive device has a drive shaft and at least one gearing mechanism, with which a rotational movement of the drive shaft can be converted to a linear movement of the at least one bending arm. Preferably, the at least one gearing mechanism has at least one gear wheel and at least one gear rack. Particularly preferably, the at least one gear wheel can be driven by the drive shaft, and the at least one gear rack is arranged on the at least one bending arm.

In this connection, it is appropriate that the drive shaft of the at least one arm drive device can be rotated about an axis of rotation, the at least one support is mounted on the frame rotatably about an axis of rotation and the axis of rotation of the drive shaft coincides with the axis of rotation of the at least one support. Preferably, the at least one arm drive device has at least one gearing mechanism with at least one gear wheel and the at least one gear wheel can be rotated about the axis of rotation of the drive shaft.

It is appropriate that a control and/or regulation device is provided, with which the at least one arm drive device and the at least one support drive device can be actuated such that the at least one bending face can perform a bending trajectory relative to the frame adapted to a predefined bend of the at least one wire, to a wire diameter of the at least one wire, and/or to a predefined bending radius of the at least one bending die. A fully automatic operation of the bending head can thereby be realized.

It has proved to be particularly advantageous that the bending head comprises several, preferably more than three, particularly preferably at least five, bending dies with different predefined bending radii, wherein a bending die changing device is provided, with which the bending dies can be moved between a bending position and at least one storage position. An automatic die change can thereby be realized, in which one of the bending dies with a suitable bending radius is selected depending on the diameter of the wire to be bent. Through a die change, wires with different diameters can be bent with the shortest possible bending legs, without losing time. In other words, the bending face can be moved during the bending process so as to avoid losing time. If the bending head comprises at least five bending dies, a large spectrum of the wire diameters used as standard can be covered.

In this connection, according to advantageous embodiments which can be realized individually or in combination with each other, the bending die changing device has a star-shaped holder with several arms. One of the bending dies is or can be arranged in each case on each arm, and/or is mounted rotatably about an axis of rotation. Preferably, the at least one support is mounted on the frame rotatably about an axis of rotation and the axis of rotation of the bending die changing device coincides with the axis of rotation of the at least one support, and/or at least one die changing drive device is provided, with which one of the bending dies can be moved from the bending position into the at least one storage position, and vice versa.

It has proved to be particularly advantageous that:

- the at least one support is mounted on the frame rotatably about an axis of rotation, and/or
- the at least one arm drive device comprises a drive shaft which can be rotated about an axis of rotation, and/or
- a bending die changing device, which is mounted rotatably about an axis of rotation, is provided.

Furthermore, at least two, and preferably all, of the axes of rotation coincide. It is thereby possible to achieve a very compact construction of the bending head. Moreover, the forces arising during operation of the bending head can be absorbed well.

According to an advantageous embodiment, a group consisting of the at least one support and the at least one bending arm arranged at and/or on the at least one support is adjustably mounted as a whole (i.e., as an integral unit) relative to the frame. Preferably, the group can be adjusted at least in a vertical direction in the position of use of the bending head, and/or at least one group drive device is provided, with which the group can be adjusted relative to the frame. It is thereby possible to adapt the distance of the bending head from the counterholder depending on the wire diameter. Moreover, the group adjustment also makes it easier to thread wires and, if a bending die changing device is provided, to change the bending dies.

It has proved to be favorable that the at least one counterholder is arranged stationary on the frame, and/or the at least one bending face is formed on a bending pin, and/or at least one position-detecting unit is provided, with which the position of at least one wire to be bent relative to the bending head can be detected, preferably wherein the at least one position-detecting unit comprises at least one laser.

In particular, the combination of at least one counterholder, which is arranged stationary on the frame, and a group adjustment of the at least one support and the at least one bending arm, which is arranged at and/or on the at least one support, relative to the frame has proved to be advantageous. On the one hand, a high stability of the counterholder can be achieved because of the stationary arrangement. On the other hand, a favorable flow of forces can be realized. If the group adjustment is effected in a vertical direction, the group adjustment only needs to be able to lift the weight of the group consisting of support and bending arm. The weight of the group consisting of support and bending arm additionally assists with the holding up during the bending.

As stated at the beginning, the invention also relates to a system for producing welded wire mesh comprising at least one bending head according to the invention, preferably at least two bending heads.

Preferred embodiments of the system are characterized in that at least one mesh table is provided, on which at least one welded wire mesh can be positioned, wherein the at least one mesh table has at least one opening, in which the at least one counterholder, the at least one bending face and the at least one bending die of the at least one bending head are or can be arranged, in order to bend at least one wire in the at least one welded wire mesh. Preferably, the at least one opening has a maximum width of 300 mm, particularly preferably of 250 mm.

Alternatively or additionally, a base frame can be provided on which the at least one bending head is arranged, and preferably the at least one bending head is arranged rotatably relative to the base frame, and at least one bending head rotary drive is provided, with which the at least one bending head can be rotated relative to the base frame, and/or the at least one bending head is arranged displaceably relative to the base frame. Particularly preferably, at least one bending head displacement drive is provided, with which the at least one bending head can be displaced relative to the base frame, and/or the system has at least two bending heads, wherein the at least two bending heads are or can be arranged on two opposite ends of the base frame.

According to further advantageous embodiments, in combination or individually, the system comprises at least one wire magazine, preferably wherein the at least one wire magazine has at least one unwinding device for a reel, and/or comprises at least one straightening machine for straightening at least one wire, and/or comprises at least one welding device for welding intersecting longitudinal wires and transverse wires together to form at least one welded wire mesh, and/or comprises at least one beam bending device for simultaneously bending a series of wires arranged next to each other, and/or comprises at least one transport device for transporting at least one welded wire mesh away, preferably wherein the at least one transport device is formed as a chain conveyor.

Finally, protection is sought for a method for bending at least one wire in a welded wire mesh by at least one bending head according to the invention, comprising the following:

- the at least one support is adjusted, preferably rotated about an axis of rotation, relative to the frame by the at least one support drive device, and
- the at least one bending arm is adjusted, preferably displaced, particularly preferably linearly displaced, relative to the frame and relative to the at least one support by the at least one arm drive device.

According to a preferred embodiment of the method, the at least one arm drive device and the at least one support drive device are actuated by a control and/or regulation device (i.e., controller) such that the at least one bending face performs a bending trajectory relative to the frame conforming to a predefined bend of the at least one wire, to a wire diameter of the at least one wire, and/or to a predefined bending radius of the at least one bending die.

In the case where the bending head comprises several, preferably more than three, particularly preferably at least five, bending dies with different predefined bending radii, it is appropriate that in a further method step at least one of the bending dies is moved between a bending position and at least one storage position by a bending die changing device, and preferably the at least one bending die is rotated relative to the frame at least in part.

Alternatively or additionally, a group consisting of the at least one support and the at least one bending arm arranged at and/or on the at least one support is adjusted as a whole relative to the frame in a further method step, preferably at least in a vertical direction in the position of use of the bending head.

BRIEF DESCRIPTION OF THE DRAWINGS

Further details and advantages of the invention are explained in more detail below with the aid of the description and reference to the drawings, in which.

DETAILED DESCRIPTION OF THE INVENTION

Figure 1:
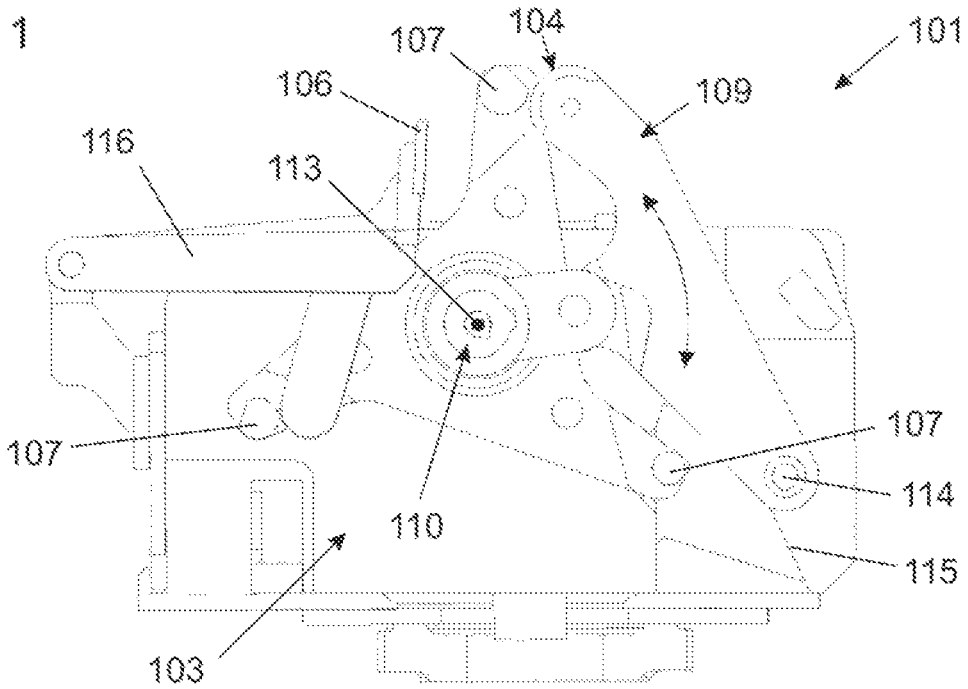
FIG. 1 shows a bending head according to the state of the art in a schematically represented side view.

FIG. 1, which shows a bending head according to the state of the art, has already been described in the introduction to the description.

Figure 2:
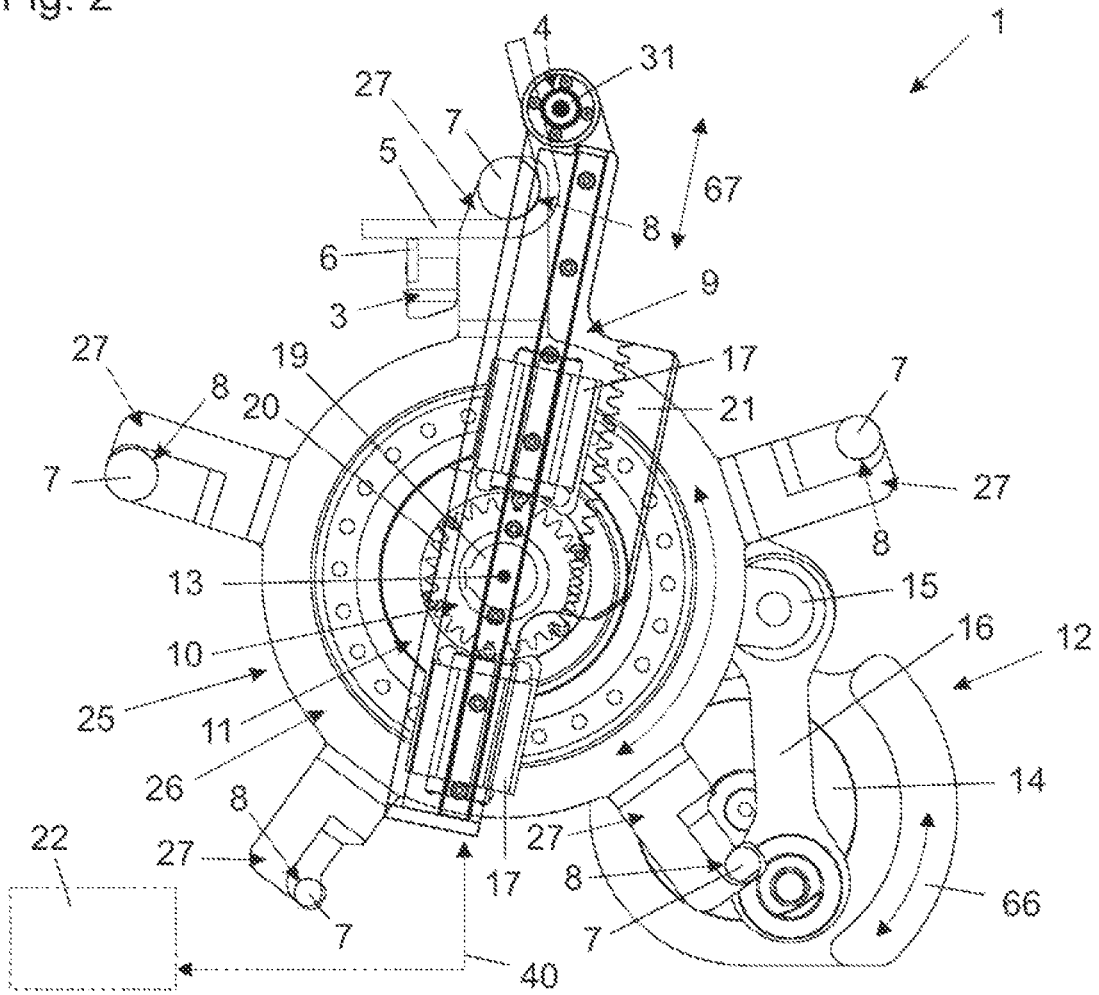
FIG. 2 shows a preferred embodiment according to the invention of a bending head in a schematically represented cross-sectional view from the side.

FIG. 2 shows a preferred embodiment according to the invention of a bending head 1 for welded wire mesh 2 (cf. also FIG. 4), comprising a frame 3, a bending face 4, which can be moved relative to the frame 3, for bending at least one wire 5 in a welded wire mesh 2, a counterholder 6, on which the at least one wire 5 can be braced during bending by the bending face 4, and several bending dies 7, which in each case, at least in part, have a predefined bending radius 8. In the specific embodiment, a total of five bending dies 7 are provided. However, a number of bending dies 7 deviating therefrom can also be used.

The bending head 1 has a bending arm 9, on which the bending face 4 is arranged, and an arm drive device 10, with which the bending arm 9 can be adjusted relative to the frame 3.

A support 11 is provided, on which the bending arm 9 is movably mounted, wherein a support drive device 12, which is separate from the arm drive device 10 and with which the support 11 can be adjusted relative to the frame 3, is provided. The support 11 is mounted on the frame 3 rotatably about an axis of rotation 13, and the bending arm 9 is arranged on the support 11 such that the axis of rotation 13 intersects the bending arm 9. An extremely compact construction of the bending head 1 is thereby achieved.

The support drive device 12 comprises a slider crank mechanism, wherein the slider crank mechanism has a crank 14, a lever 15, and a connecting rod 16. The connecting rod 16 is arranged between the crank 14, which can be moved in the direction of the double arrow 66, and the lever 15 connected to the support 11.

The bending arm 9 is linearly displaceably mounted on the support 11, and two bearings 17 are arranged on the support 11, on which in each case a guide for the bending arm 9 is formed. In the marked position of the support 11, the bending arm 9 can be moved in the direction of the double arrow 67 relative to the support 11 and relative to the frame 3, of which only a small section in the case of the counterholder 6 is marked in FIG. 2. During this movement, a distance of the bending face 4 from the pivot point 13 is altered. A leg length 44 of a bending (cf. FIG. 4) can thereby be altered in a particularly advantageous manner, to thereby move the bending face 4 during the bending process.

The arm drive device 10 has a drive shaft 19 and a gearing mechanism, with which a rotational movement of the drive shaft 19 can be converted to a linear movement of the bending arm 9. The gearing mechanism can be designed differently. In the specifically represented case, the gearing mechanism has a gear wheel 20 and a gear rack 21, wherein the gear wheel 20 can be driven by the drive shaft 19 and the gear rack 20 is arranged on the bending arm 9. If the gear wheel 20 is made to rotate, the gear rack 21 and the bending arm 9, which is connected thereto in a movement-coupled manner, are linearly moved.

It is appropriate that the arm drive device 10 and the support drive device 12 are designed with absolute encoders.

A control and/or regulation device (controller) 22 is provided, which is indicated schematically by a dashed rectangle in FIG. 2. With the control and/or regulation device 22, the arm drive device 10 and the support drive device 12 can be actuated such that the bending face 4 can perform a bending trajectory 24 relative to the frame 3 adapted (conforming) to a predefined bend of the at least one wire 5, to a wire diameter 23 of the at least one wire 5, and/or to a predefined bending radius 8 of the at least one bending die 7. The control and/or regulation device 22 can be connected to the support drive device 12 and the arm drive device 10 via one or more signal lines 40, which can also be formed wireless.

Through the combination of a rectilinear movement of the bending arm 9 and an angular movement of the support 11, it is possible to reach any desired point with the bending face 4.

Due to the construction of the bending machine with a turntable for the pivoting movement and lifting of the bending arm via a gear wheel through the middle of the turntable, this is very compact and can also be used in unfavorable spatial conditions.

It has proved to be advantageous that the control and/or regulation device 22 is designed such that a very short cycle time for a bending is achieved.

The bending head 1 of the embodiment represented can be operated fully automatically.

The bending head 1 comprises several, specifically five, bending dies 7 with different predefined bending radii 8, wherein a bending die changing device 25 is provided, with which the bending dies 7 can be moved between a bending position and at least one storage position. If a bending die 7 is in the bending position, it is arranged approximately between the counterholder 6 and the bending face 4. A position deviating therefrom in which a bending die 7 is not involved in a bending process represents a storage position. The top bending die 7 in FIG. 2 is in the bending position and the remaining bending dies 7 are arranged in a storage position.

The bending die changing device 25 has a star-shaped holder 26 with several arms 27, wherein one of the bending dies 7 is or can be arranged in each case on each arm 27. In the specifically represented case, the holder 26 has five arms 27, on the free ends of which a bending die 7 is arranged in each case.

The bending die changing device 25 is mounted rotatably about an axis of rotation 13, wherein the axis of rotation 13 of the bending die changing device 25 coincides with the axis of rotation 13 of the support 11.

A die changing drive device 28 (cf. FIG. 5*b*) is provided, with which one of the bending dies 7 can be moved from the bending position into at least one storage position, and vice versa.

With the aid of the bending die changing device 25, a suitable bending die 7 can be swapped in depending on the requirements and wire diameter 23 (cf. FIG. 4) of the wire 5 to be bent.

The bending dies 7 can have a structured surface in the region of the predefined bending radius 8, in order to increase the frictional force relative to the wire 5. For example, the structured surface can be formed barb-shaped in cross section at least in regions.

The counterholder 6 is arranged stationary on the frame 3.

The bending face 4 is formed on a bending pin 31 in the case represented.

The bending head 1 can be used in a method for bending at least one wire 5 in a welded wire mesh 2, wherein the method comprises the following method steps:

- the support 11 is adjusted relative to the frame 3 by the support drive device 12, and in the specific embodiment is rotated about an axis of rotation 13, and
- the bending arm 9 is adjusted relative to the frame 3 and relative to the support 11 by the arm drive device 10, and in the specific embodiment is linearly displaced.

In a further method step, at least one of the bending dies 7 is moved between a bending position and at least one storage position by the bending die changing device 25, wherein in the specific embodiment the at least one bending die 7 is rotated relative to the frame 3 at least in part.

Figure 3:
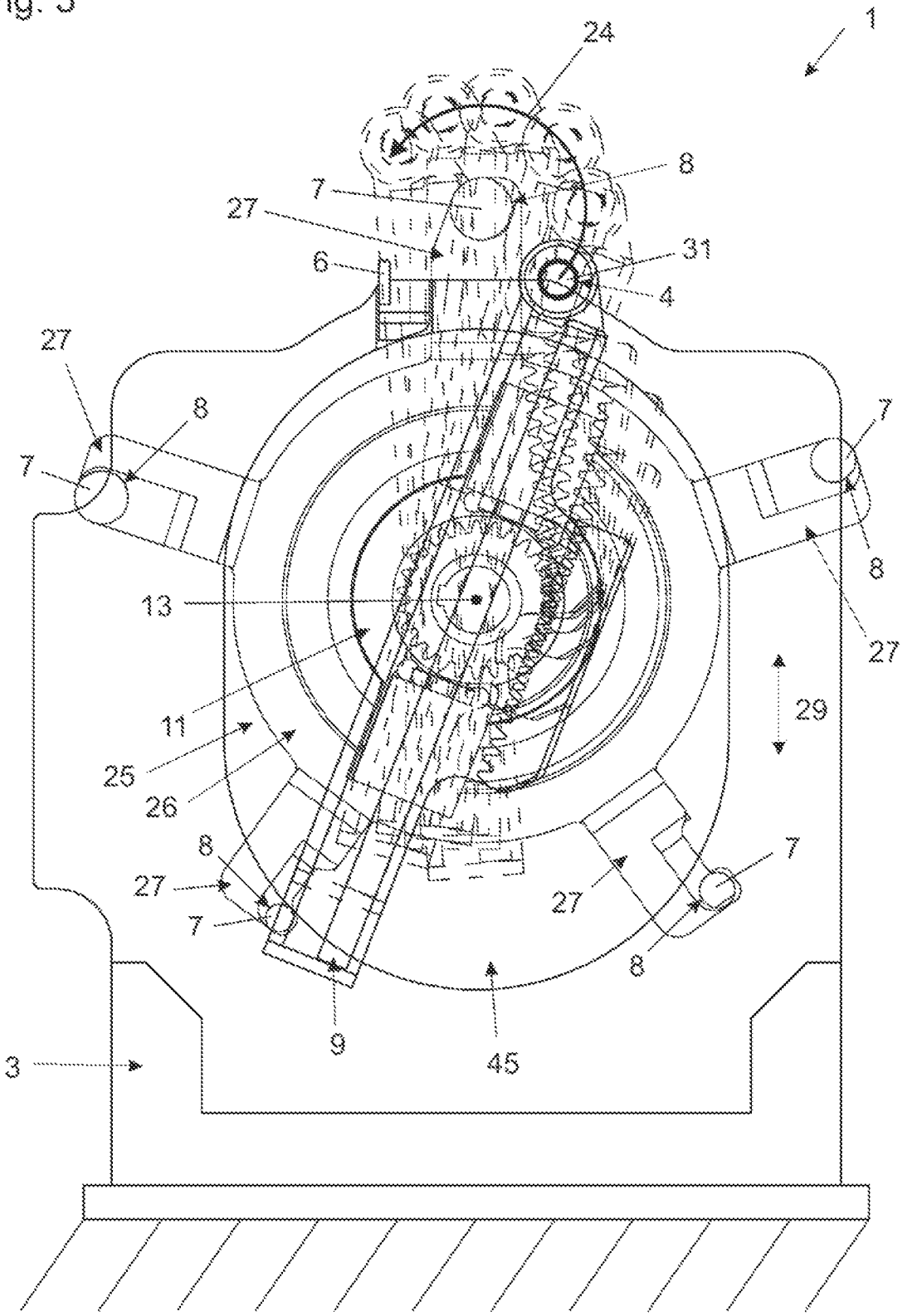
FIG. 3 shows the preferred embodiment of the bending head in a further schematically represented cross-sectional view from the side, wherein a series of positions of the bending arm passed through one after another is marked by way of example in the figure.

FIG. 3 shows the preferred embodiment of the bending head 1 in a further schematically represented cross-sectional view from the side, wherein a series of positions of the bending arm 1 passed through one after another in the course of a bending process of a wire 5 are marked by way of example in the figure.

The arm drive device 10 and the support drive device 12 are actuated by the control and/or regulation device (controller) 22 such that the bending face 4 performs a bending trajectory 24 relative to the frame 3 conforming to a predefined bend of the at least one wire 5, to a wire diameter 23 of the at least one wire 5, and/or to a predefined bending radius 8 of the at least one bending die 7. In the specifically represented case, for example, it is appropriate to guide the bending face 4 or the bending pin 31 on a substantially circular bending trajectory 24 around the bending die 7.

A larger part of the frame 3 is represented in FIG. 3. It is appropriate that a group consisting of the support 11 and the bending arm 9 arranged on the support 11 is mounted as a whole adjustably relative to the frame 3, and the group can be adjusted in a vertical direction 29 in the position of use of the bending head 1. A group drive device 30 (cf. FIG. 5*b*) is provided, with which the group can be adjusted relative to the frame 3.

The frame 3 can have an opening 45, inside which the group can be adjusted. The opening 45 can for example be formed in the shape of an elongated hole and/or have end stops, which define the maximum positions of the group relative to the frame 3.

The bending head 1 can be used in a method for bending at least one wire 5 in a welded wire mesh 2. It is appropriate that the group consisting of the support 11 and the bending arm 9 arranged on the support 11 is adjusted as a whole relative to the frame 3 in a method step, namely at least in a vertical direction 29 in the position of use of the bending head 1. This method step makes it easier to change dies in the case of a limited table cutout in a mesh table 33 (cf. FIG. 4) and/or to thread a wire 5. Moreover, the distance of the bending head 1 from the counterholder 6 can be optimally conforming to the wire diameter 23 of the wire 5 to be bent.

Figure 4:
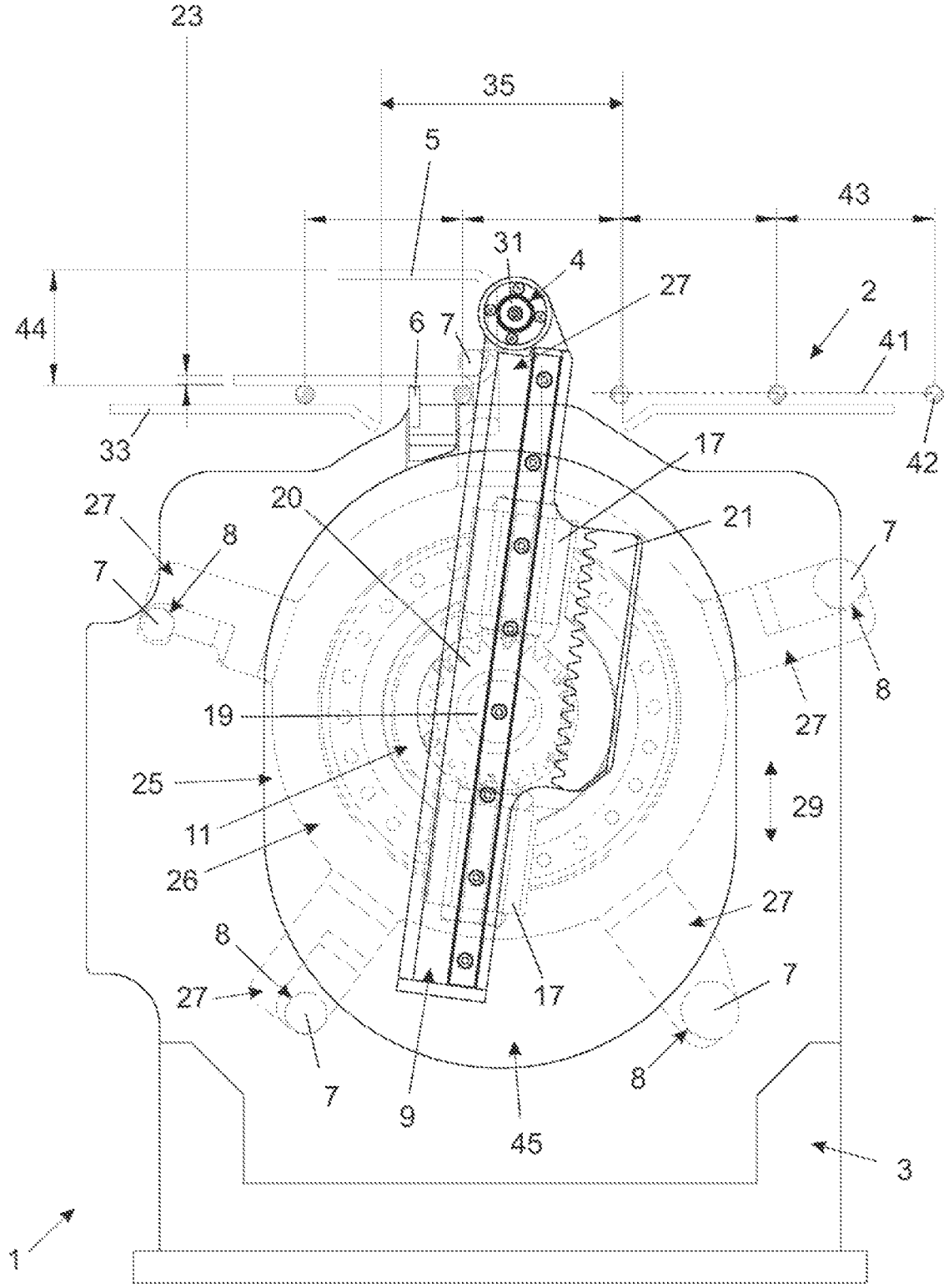
FIG. 4 shows the preferred embodiment of the bending head in a further schematically represented cross-sectional view from the side, wherein a mesh table and a cutout in a welded wire mesh arranged thereon are additionally represented.

FIG. 4 shows a preferred embodiment of the bending head 1 in a further schematically represented cross-sectional view from the side, wherein a mesh table 33 and a cutout in a welded wire mesh 2 arranged thereon are additionally represented.

A mesh table 33 is thus provided, on which at least one welded wire mesh 2 can be positioned, wherein the mesh table 33 has at least one opening (having a width indicated by double arrow 35 in FIG. 4), in which the counterholder 6, the bending face 4, and the at least one bending die 7 of the bending head 1 are or can be arranged, in order to bend at least one wire 5 in the at least one welded wire mesh 2.

The construction of the bending head 1 makes it possible to design the at least one opening relatively small compared with the state of the art. For example, the opening has a maximum width 35 of 300 mm, particularly preferably of 250 mm.

Of the cutout in the welded wire mesh 2, several transverse wires 42 arranged next to each other are represented. These are arranged in a first mesh layer 41. The distance 43 between the transverse wires 42 can be 150 mm for example. This distance 43 is sufficient to carry out all bending processes by the bending head 1.

In the specifically represented case, the welded wire mesh 2 comprises a wire 5 which is bent in two partial bends of in each case 90° with the aid of the bending head 1. The leg length 44 between the two partial bends is e.g. 110 mm. A second mesh layer can be fastened to the section of the wire 5 bent upwards. In this case, the wire 5 acts as a spacer from the second mesh layer.

In the course of a bending process, the wire 5 is pressed upwards in the vertical direction 29 by the bending face 4 of the bending arm 9 and in the process is bent around the bending die 7. The wire 5 is held by the stationary counterholder 6. Because the bending die changing device 25 can be adjusted in the vertical direction 29, the die's lower edge can adapt to the wire diameter 33, which can be 8 mm for example.

Because of the stationary counterholder 6 and the adjustable bending die changing device 25, an advantage additionally results to the effect that the weight of the group consisting of bending arm 9 and support 11 assists with the holding up during the bending and the group drive device 30 only needs to be able to hold the weight of the group. The group drive device 30 need not absorb any force from the bending.

Figure 5A:
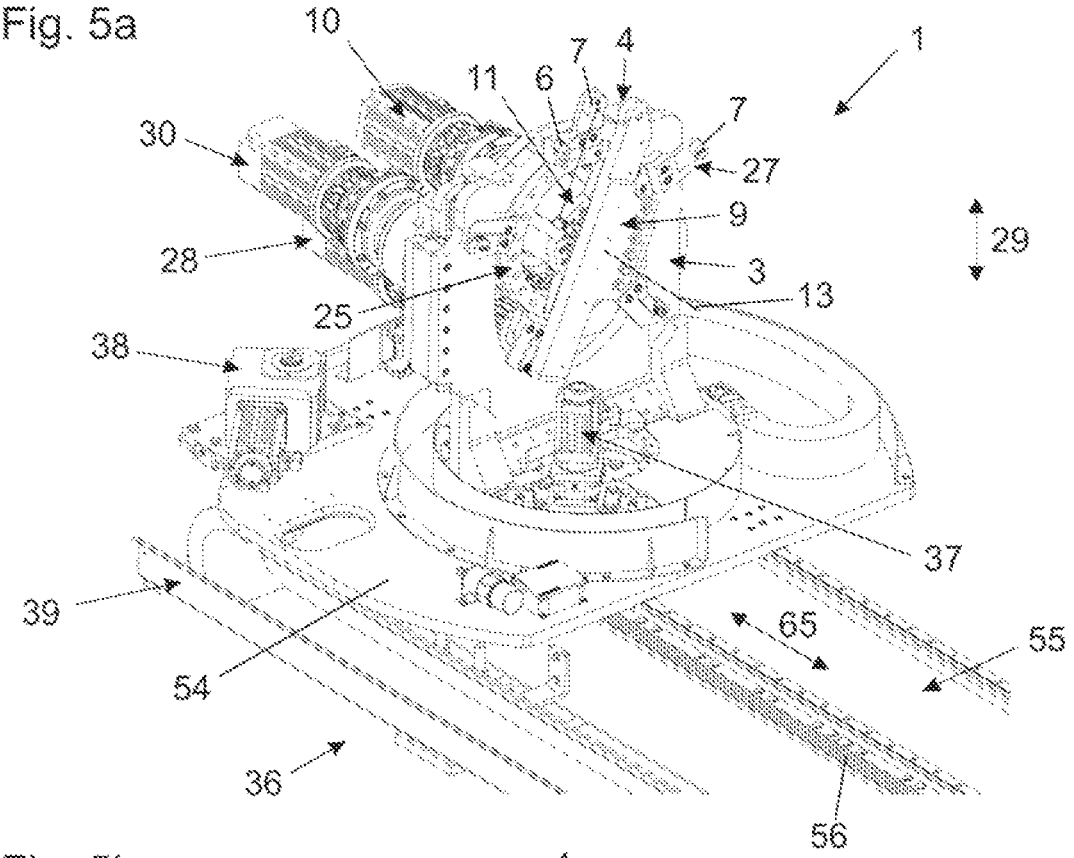
FIGS. 5*a*, 5*b* show the preferred embodiment of the bending head in two different schematically represented perspective views.
Figure 5B:
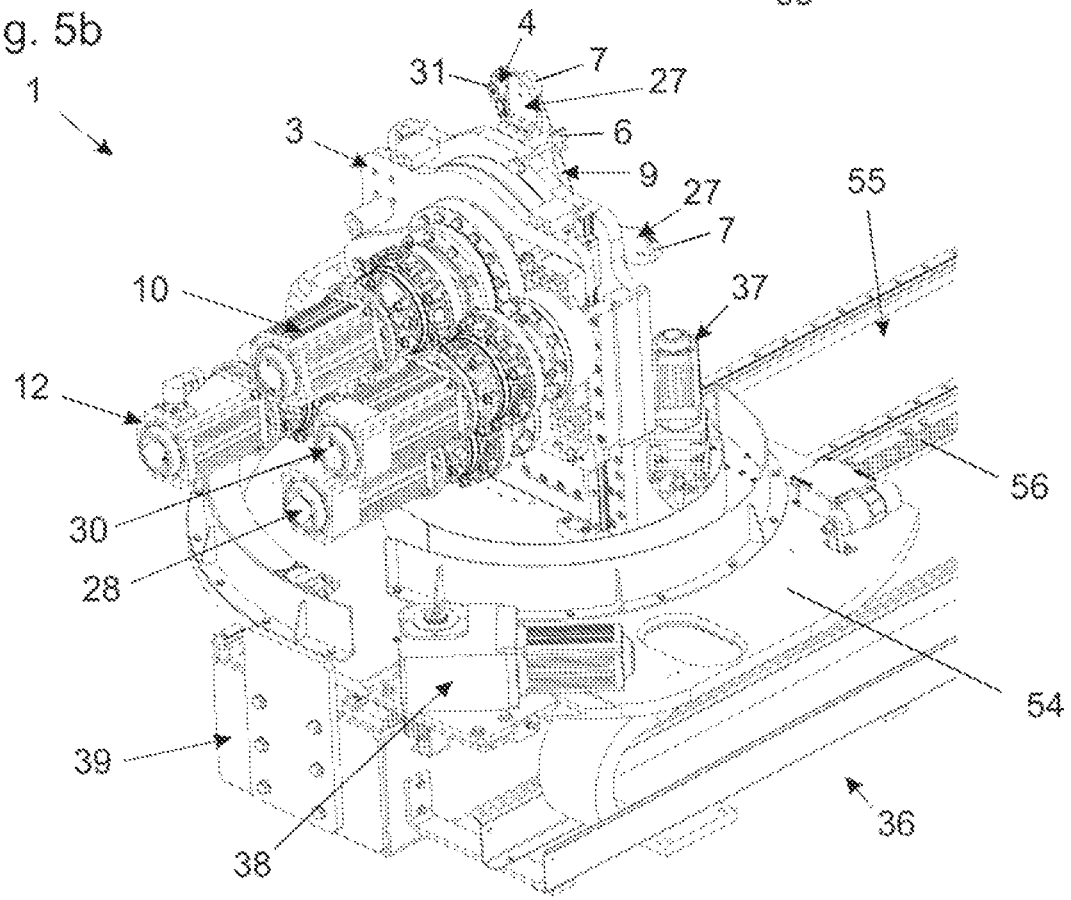
Figure 5C:
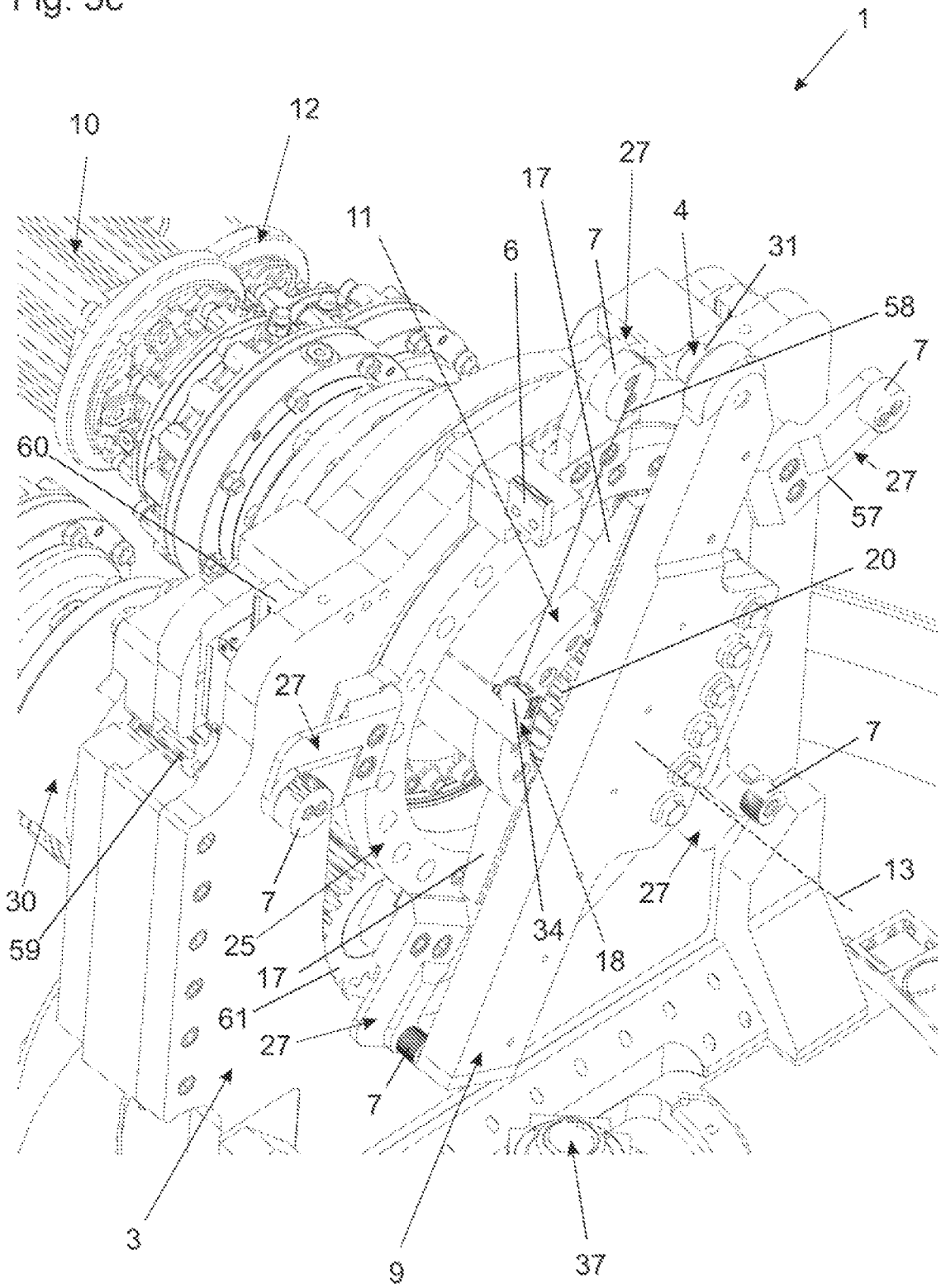
FIG. 5*c* shows the preferred embodiment of the bending head in a further schematically represented perspective view.

FIGS. 5*a*, 5*b* and 5*c* show the preferred embodiment of the bending head 1 in different schematically represented perspective views.

A base frame 36 is provided, on which the bending head 1 is arranged, wherein the bending head 1 is arranged rotatably relative to the base frame 36. A bending head rotary drive 37 is provided, with which the bending head 1 can be rotated relative to the base frame 36.

The bending head 1 is arranged displaceably relative to the base frame 36, wherein a bending head displacement drive 38 is provided, with which the bending head 1 can be displaced relative to the base frame 36.

The displaceable arrangement can be realized by a guide 55 as in the case represented. A gearing 56, in which a drivable gear wheel of the bending head displacement drive 38 engages, can be formed on the guide 55.

The frame 3 of the bending head 1 is arranged on a base 54, which can be formed e.g. in the shape of a plate.

Another further bending head 1 can also be arranged on the base frame 36, with the result that a total of two bending heads 1 are or can be arranged on two opposite ends 39 of the base frame 36.

As follows from FIG. 5*c*, a position-detecting unit 18 can be provided, with which the position of at least one wire 5 to be bent relative to the bending head 1 can be detected, and the position-detecting unit 18 in the case represented comprises a laser 34. The laser 34 can emit a laser beam 58, which runs substantially parallel to the bending arm 9 and in the wire plane due to the arrangement in the specific case.

The bending dies 7 can be arranged on retaining plates 57, wherein the retaining plates 57 can be releasably connected to the star-shaped holder 26. In this way, when worn out or as needed, the bending dies 7 can be replaced with a bending die 7 not held in stock having a further predefined bending radius 8 in a few maneuvers.

The group drive device 30 can have a gear wheel 59 and a guide 60 for adjusting the group consisting of bending arm 9 and support 11.

The die changing drive device 28 can have a gear wheel 61.

Figure 6:
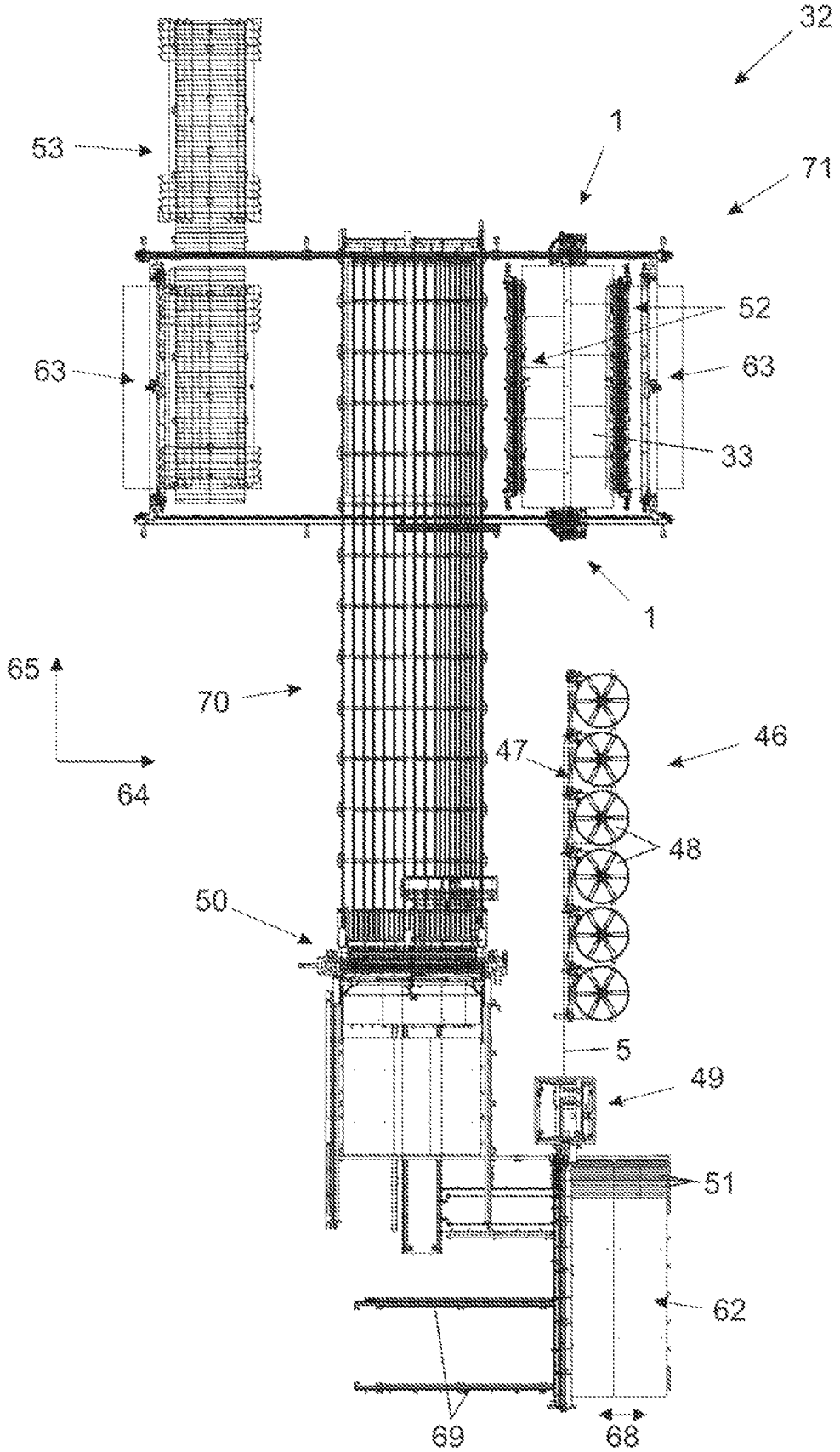
FIG. 6 shows a preferred embodiment of a system for producing welded wire mesh in a schematically represented top view from above.

FIG. 6 shows a preferred embodiment of a system 32 for producing welded wire mesh 2.

The system 32 comprises a wire magazine 46, wherein the wire magazine 46 has an unwinding device 47 for several reels 48, on which wires 5 with different properties, e.g. different wire diameters 23, can be stored. The system 32 further comprises a straightening machine 49 for straightening at least one wire 5 unwound from one of the reels 48, and a welding device 50 for welding intersecting longitudinal wires 51 and transverse wires 42 together to form at least one welded wire mesh 2.

As in the embodiment represented, the longitudinal wires 51 are conveyed from the straightening machine 49 in the direction of the welding device 50 by a platform 62 guided on rails 69 in the direction of the double arrow 69.

The transverse wires 42 can be fed to the welding device 50 for example in a transverse direction 65.

The welded wire mesh 2 welded together by the welding device 50 can be conveyed further in the transverse direction 65 along a transverse table 70. A bending station 71 extends in the longitudinal direction 64 on one side of the transverse table 70. The bending station 71 comprises two bending heads 1, which can be designed according to the embodiment example represented in FIGS. 2 to 5*c*.

Furthermore, neighboring the bending heads 1, beam bending devices 52 can be provided for simultaneously bending a series of wires 5 arranged next to each other.

A transport device 53 for transporting at least one welded wire mesh 2 away is arranged on an opposite side of the transverse table 70, wherein the transport device 53 can be formed e.g. as a chain conveyor. The finish-machined welded wire mesh 2 can be taken out of the transport device 53 manually for example.

Mesh grippers 63 can be provided, with which the welded wire mesh 2 can be moved between the transverse table 70, the bending station 71 and the transport device 53.

The invention claimed is:

1. A bending head for welded wire mesh, comprising:

a frame, a bending face configured to be moved relative to the frame to bend a wire in a welded wire mesh, a counterholder configured to allow the wire to be braced thereon during a bending process by the bending face, a bending die having a predefined bending radius, a bending arm having the bending face is arranged thereon, an arm drive device configured to adjust the bending arm relative to the frame so as to move the bending face during the bending process, a support at which the bending arm is movably mounted, and wherein a support drive device separate from the arm drive device and configured to adjust the support relative to the frame, and wherein the bending arm is mounted so as to be linearly displaceable at the support.

2. The bending head according to claim 1, wherein the support is mounted on the frame rotatably about an axis of rotation.

3. The bending head according to claim 1, wherein the support drive device comprises a slider crank mechanism.

4. The bending head according to claim 3, further comprising a bearing arranged on the support, a guide for guiding the bending arm being formed on the bearing.

5. The bending head according to claim 1, wherein the arm drive device has a drive shaft and a gearing mechanism configured to convert a rotational movement of the drive shaft to a linear movement of the bending arm.

6. The bending head according to claim 5, wherein the drive shaft of the arm drive device is rotatable about an axis of rotation, the support is mounted on the frame rotatably about an axis of rotation, and the axis of rotation of the drive shaft coincides with the axis of rotation of the support.

7. The bending head according to claim 1, further comprising a controller configured to actuate the arm drive device and the support drive device such that the bending face performs a bending trajectory relative to the frame conforming to a predefined bend of the wire, to a wire diameter of the wire, and/or to a predefined bending radius of the bending die.

8. The bending head according to claim 1, wherein the bending die is one of a plurality of bending dies with different predefined bending radii, the being head further comprising a bending die changing device configured to move each of the plurality of bending dies between a bending position and a storage position.

9. The bending head according to claim 8, wherein:

the bending die changing device has a star-shaped holder with several arms, wherein a respective one of the plurality of bending dies is to be arranged on each arm, and/or the bending die changing device is mounted rotatably about an axis of rotation, the support being mounted on the frame rotatably about an axis of rotation and the axis of rotation of the bending die changing device coinciding with the axis of rotation of the support, and/or the bending head further comprises a die changing drive device configured to selectively move each one of the bending dies between the bending position and storage position.

10. The bending head according to claim 1, wherein:

the support is mounted on the frame rotatably about a first axis of rotation, and/or the arm drive device comprises a drive shaft rotatable about a second axis of rotation, and/or the bending head further comprises a bending die changing device mounted rotatably about a third axis of rotation, and wherein at least two of the first axis of rotation, the second axis of rotation, and the third axis of rotation coincide.

11. The bending head according to claim 1, wherein a group consisting of the support and the bending arm arranged at the support is adjustably mounted as an integral unit relative to the frame.

12. The bending head according to claim 1, wherein:

the counterholder is stationary on the frame, and/or the bending face is formed on a bending pin, and/or the bending head further comprises a position-detecting unit configured to detect a position of the wire to be bent relative to the bending head.

13. A system for producing welded wire mesh, comprising:

a base frame, and the bending head according to claim 1 arranged on the base frame.

14. The system according to claim 13, further comprising a mesh table on which a welded wire mesh is to be positioned, wherein the mesh table has an opening in which the counterholder, the bending face, and the bending die of the bending head are to be arranged to bend the wire in the welded wire mesh.

15. The system according to claim 13, wherein:

the bending head is arranged rotatably relative to the base frame, and the system further comprises a bending head rotary drive configured to rotate the bending head relative to the base frame, and/or the bending head is arranged displaceably relative to the base frame, and the system further comprises a bending head displacement drive configured to move the bending head relative to the base frame, and/or the bending head is one of at least two bending heads arranged on two opposite ends of the base frame.

16. The system according to claim 13, wherein the system comprises at least one of:

a wire magazine including an unwinding device for unwinding a reel holding the wire, a straightening machine for straightening the wire, a welding device for welding intersecting longitudinal wires and transverse wires together to form the welded wire mesh, a beam bending device for simultaneously bending a series of wires arranged next to each other, and a transport device for transporting the welded wire mesh away, transport device being a chain conveyor.

17. A method for bending a wire in a welded wire mesh using the bending head according to claim 1, the method comprising:

adjusting the support by rotating the support about an axis of rotation relative to the frame via the support drive device, and adjusting the bending arm by linearly displacing the bending arm relative to the frame and relative to the support by the arm drive device.

18. The method according to claim 17, further comprising actuating the arm drive device and the support drive device by a controller such that the bending face performs a bending trajectory relative to the frame conforming to a predefined bend of the wire, to a wire diameter of the wire, and/or to a predefined bending radius of the bending die.

19. The method according to claim 17, wherein the bending head comprises a plurality of bending dies with different predefined bending radii, of the method further comprising moving the bending dies between a bending position and a storage position by a bending die changing device, and rotating the bending die relative to the frame.

20. The method according to claim 17, further comprising adjusting a group consisting of the support and the bending arm arranged at the support as an integral unit relative to the frame in a vertical direction in a use position of the bending head.

21. The bending head according to claim 2, wherein the bending arm is arranged at the support such that the axis of rotation intersects the bending arm.

22. The bending head according to claim 3, wherein the slider crank mechanism includes crank, a lever, and/or a connecting rod.

23. The bending head according to claim 4, wherein the bearing is one of two bearings arranged on the support.

24. The bending head according to claim 5, wherein the gearing mechanism includes a gear wheel and a gear rack, and the gear wheel is configured to be driven by the drive shaft and the gear rack is arranged on the bending arm.

25. The bending head according to claim 6, wherein the gearing mechanism includes a gear wheel rotatable about the axis of rotation of the drive shaft.

26. The bending head according to claim 8, wherein the bending die is one of at least five bending dies with different predefined bending radii.

27. The bending head according to claim 11, wherein:

the group is adjustable in a vertical direction in a use position of the bending head, and/or the bending head further comprises a group drive device to adjust the group relative to the frame.

28. The bending head according to claim 12, wherein the position-detecting unit includes a laser.

29. The system according to claim 13, wherein the bending head is one of at least two bending heads.

30. The system according to claim 14, wherein the opening has a maximum width of 250 mm.

* * * * *